US006350021B1

(12) United States Patent
Gray et al.

(10) Patent No.: US 6,350,021 B1
(45) Date of Patent: Feb. 26, 2002

(54) INK JET PRINTING SYSTEM

(75) Inventors: Colin Gray, Huntingdon (GB); Anthony John Shacklock, Auckland (NZ)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/142,429

(22) PCT Filed: Feb. 20, 1997

(86) PCT No.: PCT/GB97/00487

§ 371 Date: Mar. 29, 1999

§ 102(e) Date: Mar. 29, 1999

(87) PCT Pub. No.: WO97/30850

PCT Pub. Date: Aug. 28, 1997

(30) Foreign Application Priority Data

Feb. 22, 1996 (GB) ..... 9603813

(51) Int. Cl.[7] ..... B41J 2/12
(52) U.S. Cl. ..... 347/78
(58) Field of Search ..... 347/68, 69, 70, 347/71, 72, 50, 40, 20, 54, 78; 399/261; 361/700; 310/328–330; 29/890.1

(56) References Cited

U.S. PATENT DOCUMENTS 4,555,709 A * 11/1985 Greeson
4,827,280 A * 5/1989 Stamer et al.

FOREIGN PATENT DOCUMENTS

| | | | |
|---|---|---|---|
| EP | 0 046 385 A1 | 2/1982 | ..... B41J/3/04 |
| EP | 0 354 715 A2 | 2/1990 | ..... B41J/2/175 |
| GB | 2 004 503 A | 4/1979 | ..... B41J/3/04 |
| GB | 1 584 073 | 2/1981 | ..... B41J/27/18 |
| GB | 2 089 733 A | 6/1982 | ..... B41J/3/04 |
| GB | 2 113 151 A | 8/1983 | ..... B41J/3/04 |
| WO | WO 91/17052 | 11/1991 | ..... B41J/2/175 |

* cited by examiner

*Primary Examiner*—Raquel Yvette Gordon
(74) *Attorney, Agent, or Firm*—Joel H. Bootzin; Piper Marbury Rudnick & Wolfe

(57) ABSTRACT

An ink jet printing system comprising a droplet generator (5), a supply tank (3), supply transfer means for driving the ink from said tank to said generator and means for measuring the flow rate of the stream of ink droplets by monitoring the change of ink level in said tank, said system including a bleed connection (19) from the generator to the tank in closed circuit with said tank. An ink jet printing system comprising means for using measurements of the rate of change of liquid level in an ink supply tank to provide an indication that there has been a fault in the system. An ink jet printing system comprising a holding tank (101) for receiving liquid issued from the ink jet generator during preparation of the system.

14 Claims, 4 Drawing Sheets

INK JET PRINTING SYSTEM

This invention relates to an ink jet printing system.

U.S. Pat. No. 4,555,712 discloses an ink jet printing system comprising: a droplet generator for generating a stream of ink droplets; a supply tank for supplying ink to the generator; a pressure source for applying pressure to the ink in the supply tank to force it to the droplet generator; a gutter for collecting ink droplets not used in printing; a return tank for receiving the ink collected in the gutter; and a pump for pumping ink from the return tank to the supply tank. The printing system further comprises a measurement system for measuring the flow rate of the steam of ink droplets generated by the generator by monitoring the change of ink level in the supply tank when ink is not being pumped from the return tank to the supply tank.

In ink jet printing it is known to increase the rate of flow of ink to a droplet generator without increasing the flow rate of the stream(s) of ink droplets generated by the generator, by providing a bleed connection from the droplet generator. An example of this is disclosed in U.S. Pat. No. 4,555,709.

Ink jet printing systems are cleaned before, after, and, when required, during use by flushing with ink solvent. Solvent flushes out of the droplet generator of the system via its droplet forming nozzle(s). It is known to supply this solvent to the tank which directly supplies the droplet generator during printing, resulting in an undesirable dilution of the printing ink. Solvent is also flushed out of the droplet generator via its bleed outlet, if it has one. It is known to dump this solvent, which wastes solvent, is environmentally unfriendly, and labour intensive in that the dumping is required to be carried out.

According to a first aspect of the present invention there is provided an ink jet printing system comprising: a droplet generator for generating at least one stream of ink droplets; a supply tank for supplying ink to said generator; supply transfer means for driving the ink from said tank to said generator; and measurement means for measuring the flow rate of the stream(s) of ink droplets generated by said generator by monitoring the change of ink level in said tank, said system including a bleed connection from said generator to said tank in closed circuit with said tank, the presence of said bleed connection thereby increasing the rate of flow of ink from said tank to said generator without affecting the measurement by said measurement means of the flow rate of the stream(s) of ink droplets generated by said generator.

According to a second aspect of the present invention there is provided an ink jet printing system comprising: a droplet generator for generating at least one stream of ink droplets; a supply tank for supplying ink to said generator; supply transfer means for driving the ink from said tank to said generator; a holding tank for receiving liquid issued by said generator during preparation of the system for subsequent printing, said holding tank being connected to said supply tank for the supply of said liquid to the supply tank during said subsequent printing; and means for determining during said subsequent printing the times at which the composition of the ink supplied to said generator is such that it is appropriate to use the liquid contained in said holding tank.

According to a third aspect of the present invention there is provided an ink jet printing system comprising: a tank for holding a liquid for use in the operation of said system; a multi-level or continuous level sensor for measuring the rate of change of liquid level in said tank during said operation; and means for using this measurement to provide an indication that there has been a fault in said system.

An ink jet printing system in accordance with the present invention will now be described, by way of example, with reference to the accompanying drawings in which.

Figure 1:
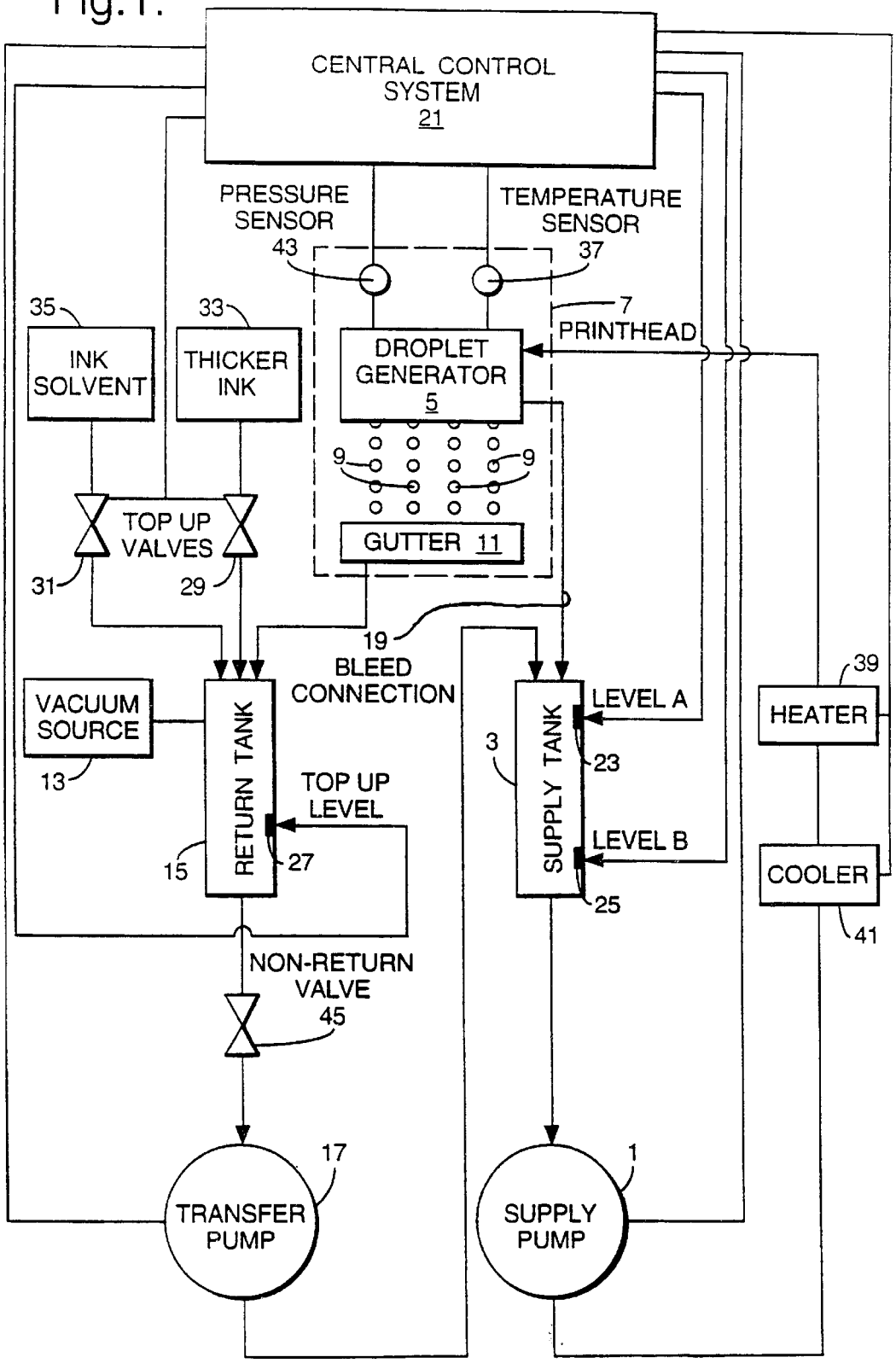
FIG. 1 is a block schematic diagram of the system.

Referring to FIG. 1, a supply pump 1 pumps ink from a supply tank 3 to the droplet generator 5 of a printhead 7. Droplet generator 5 generates a plurality of streams of ink droplets 9, and a gutter 11 of the printhead 7 collects ink droplets not used in printing. A vacuum source 13 draws ink collected in gutter 11 to a return tank 15. A bleed connection 19 continuously bleeds ink from generator 5 to supply tank 3.

In the printing system the flow rate of the streams of ink droplets 9 is measured as follows. Ink level sensors 23, 25 are located respectively at levels A and B of supply tank 3. A central control system 21 measures the time it takes for the ink to fall from level A to level B. This provides a measure of the flow rate of the streams of ink droplets 9. In this connection it is to be appreciated that, since all the ink which leaves generator 5 via bleed connection 19 returns directly to supply tank 3, the loss of ink via bleed connection 19 will have no nett effect on the using up of ink in supply tank 3. Hence, the time taken for the ink level to drop from A to B provides an accurate measure of the flow rate of the streams of ink droplets 9 generated by generator 5. In other words, since supply tank 3, droplet generator 5, and bleed connection 19 are in closed circuit, the rate of drop of ink level in supply tank 3 is an accurate representation of the flow rate of the streams of ink droplets 9 generated by generator 5.

A transfer pump 17 pumps ink from return tank 15 via a non-return valve 45 to supply tank 3. When the ink level in supply tank 3 falls below level B, control system 21 starts pump 17. When the ink level in supply tank 3 rises above level A, control system 21 stops pump 17. The flow rate measurement of the previous paragraph is made by control system 21 when ink is not being pumped from return tank 15 to supply tank 3.

For accurate printing the velocity of the streams of ink droplets 9 is maintained at a constant value. This is achieved by means of central control system 21 which maintains constant the composition, temperature, and pressure of the ink in droplet generator 5.

The composition is maintained as follows. To replace ink used up in printing, an ink level sensor 27 is located at a top-up level in return tank 15. When the level of the ink in tank 15 drops below the top-up level, control system 21 opens valves 29 and 31 to reservoirs 33 and 35 respectively. Reservoir 33 contains the same ink as supplied to generator 5 but with a slightly lower proportion of ink solvent therein so that it is slightly more viscous. Reservoir 35 contains ink solvent. Vacuum source 13 draws into return tank 15 ink and ink solvent from reservoirs 33, 35. Control system 21 keeps open valves 29 and 31 for relative periods such that an ink of the same viscosity as that supplied to generator 5 resides in return tank 15, i.e. the aforementioned slightly lower proportion of ink solvent in the ink of reservoir 33 is offset by the ink solvent drawn from reservoir 35. To replace ink solvent which has evaporated in the course of printing or which has been added in the course of printing as a consequence of cleaning the printhead 7 with solvent, the flow rate measurement made using level sensors 23, 25 is used by control system 21 to determine whether to add ink solvent from reservoir 35 or thicker ink from reservoir 33. If the flow rate measurement made is less than the desired flow rate, the assumption is that ink solvent has been lost through evaporation, and hence control system 21 opens valve 31 so that ink solvent is drawn into return tank 15. If the flow rate measurement made is greater than the desired flow rate, the assumption is that ink solvent has been added through cleaning, and hence control system 21 opens valve 29 so that thicker ink is drawn into return tank 15. Of course, any error in the relative mixing to replace ink used up in printing, i.e. the relative mixing of ink and ink solvent from reservoirs 33, 35, will be corrected for by control system 21 in response to the flow rate measurements made using level sensors 23, 25.

Central control system 21 maintains the temperature constant using a temperature sensor 37 to sense the temperature of the ink in generator 5, and a heater 39 and cooler 41 located in the ink supply path from supply pump 1 to generator 5. In dependence on the temperature sensed, operation of heater 39 and cooler 41 is controlled so that the desired ink temperature in generator 5 is maintained. In this connection it is to be appreciated that, since the presence of bleed connection 19 increases the ink flow rate to generator 5, it enhances temperature control, since there is less time between heater/cooler 39/41 and generator 5 during which cooling of the ink can occur.

Central control system 21 maintains the pressure constant using a pressure sensor 43 to sense the pressure of the ink in generator 5. In dependence on the pressure sensed, the speed of supply pump 1 is adjusted so that the desired ink pressure in generator 5 is maintained.

In the above description the velocity of the streams of ink droplets 9 is maintained constant by maintaining constant each of the composition, temperature, and pressure of the ink in droplet generator 5. It is to be appreciated that this velocity maintenance could also be achieved by allowing each of the composition, temperature, and pressure to vary within predefined limits, but to control this variation such that the result of the combination of all three parameters always results in the same desired velocity of the streams of ink droplets 9. The requirement is that the three parameters are controlled such that the velocity is maintained constant.

It is also to be appreciated that the ink held in reservoir 33 need not be thicker than that supplied to generator 5, but could be of the same consistency. In this case, when the ink level in return tank 15 drops below the top-up level, only ink from reservoir 33 is supplied to return tank 15. When ink solvent is lost through evaporation, as before, valve 31 is opened to supply ink solvent from reservoir 35. When ink solvent is added in cleaning, ink from reservoir 33 is supplied.

It is further to be appreciated that supply pump 1 could be replaced by a pressure source which applies pressure to the ink in supply tank 3 to force it out and around to generator 5. In this case a pump would be required in bleed connection 19.

The sensing of ink level in tanks 3, 15 could be achieved, not by means of sensors 23, 25, 27 located at fixed positions within tanks 3, 15, but by one sensor in each tank 3, 15 which floats on the surface of the ink and therefore changes level therewith.

Figure 2:
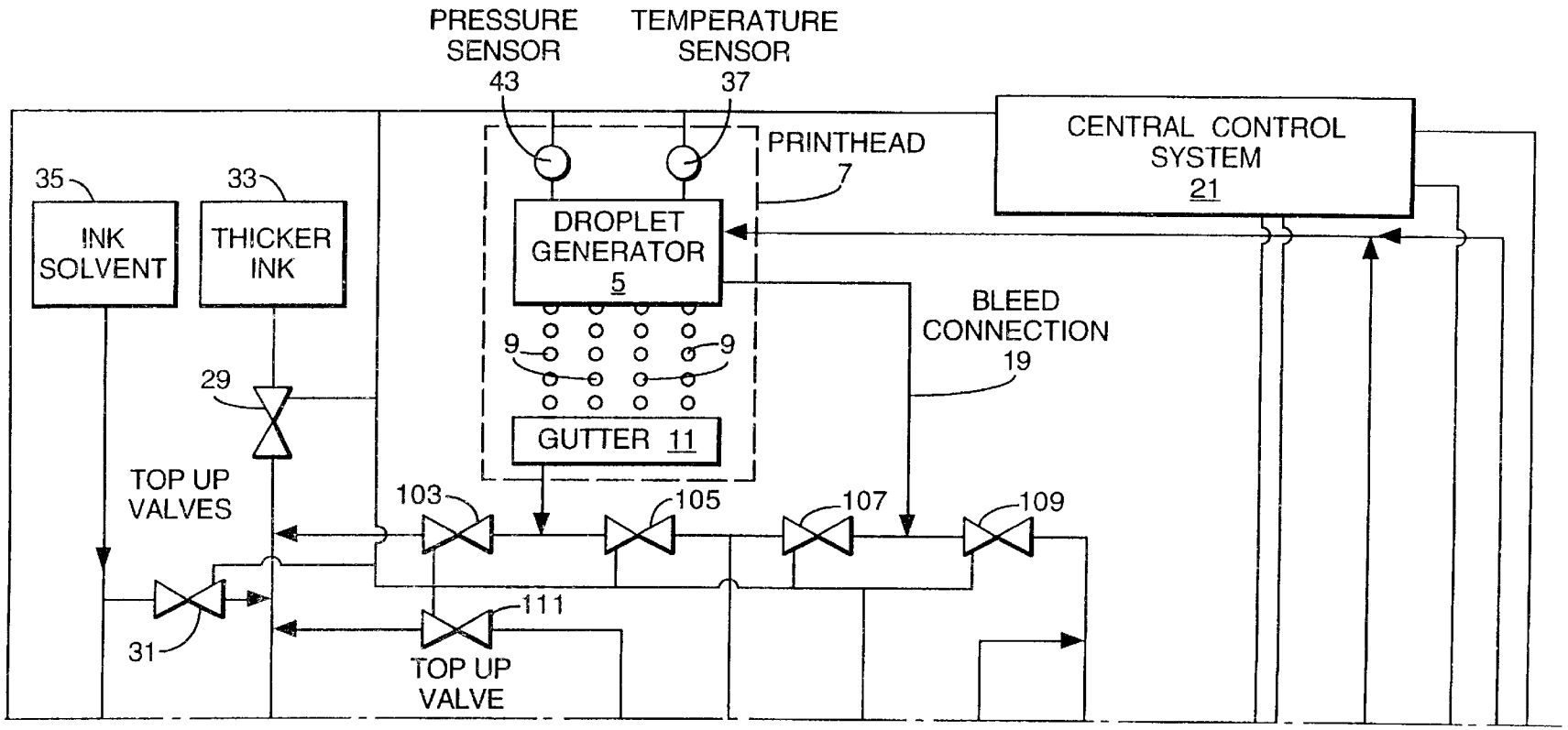
FIG. 2 shows a development of the system of FIG. 1.
Figure 2:
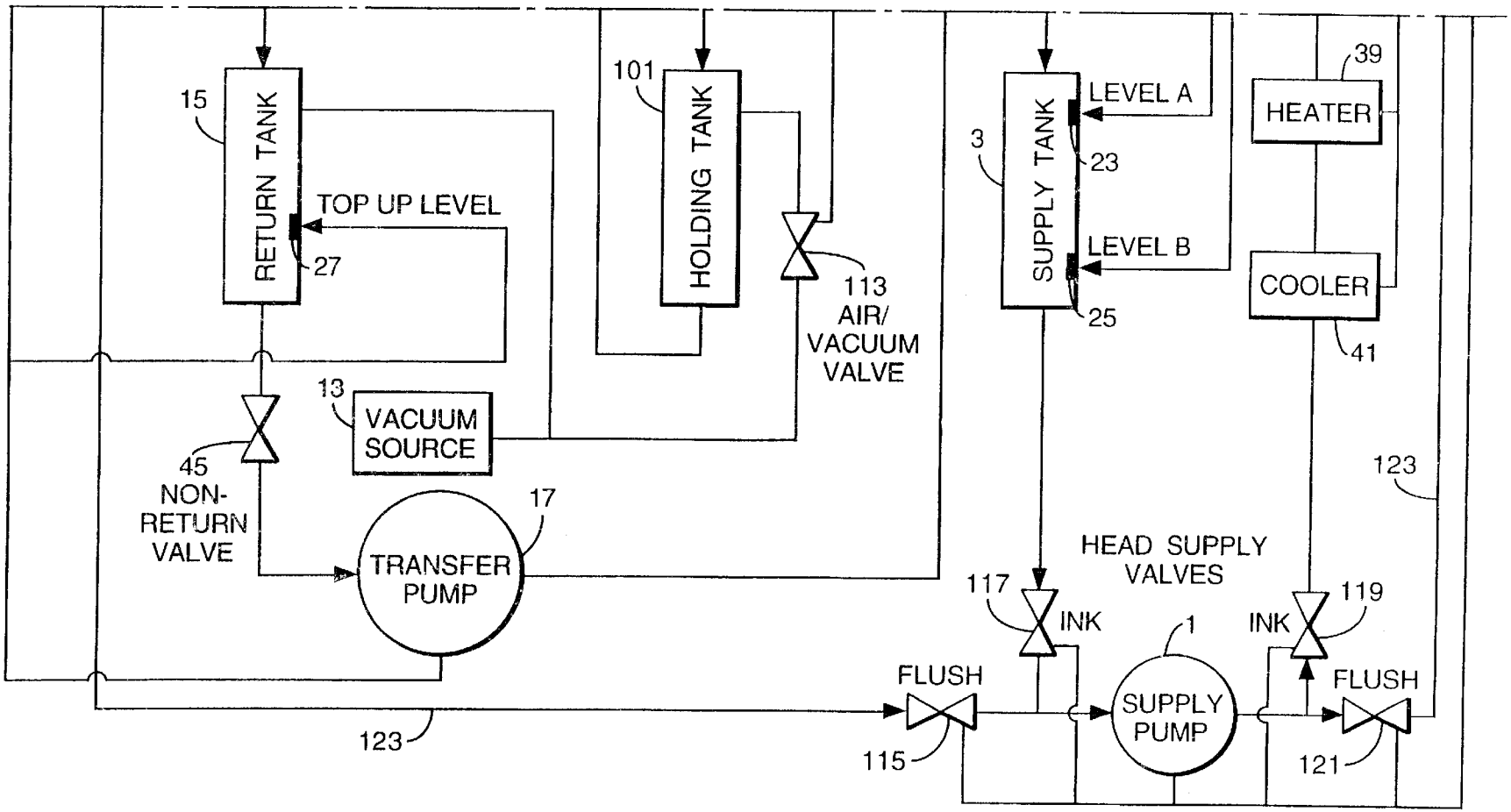

Referring to FIG. 2, in the development a holding tank 101, various valves 103, 105, 107, 109, 111, 113, 115, 117, 119, 121, and a flush path 123, have been added to the system of FIG. 1.

During normal operation of the system, i.e. during printing by the system as described with reference to FIG. 1, control system 21 opens valves 103, 109, 117 and 119, and closes valves 105, 107, 115, 121 and 111. Thus, as described with reference to FIG. 1: ink in gutter 11 is drawn into return tank 15 by vacuum source 13; ink is continuously bled from droplet generator 5 to supply tank 3 via connection 19; and ink is pumped by supply pump 1 from supply tank 3 to droplet generator 5 via heater 39 and cooler 41.

Prior to printing by the system during start-up of the system, control system 21 opens valves 105, 107, 115 and 121, closes valves 103, 109, 117, 119 and 111, and switches valve 113 to connect to vacuum source 13—valve 113 may be switched to connect holding tank 101 to either source 13 or atmospheric pressure. Supply pump 1 pumps ink solvent from reservoir 35 around flush path 123 to generator 5. The ink solvent which collects in gutter 11 is drawn into holding tank 101 by vacuum source 13. Solvent is also drawn by source 13 into holding tank 101 from bleed connection 19. Thus, following start-up, ink solvent used to flush clean the system resides in holding tank 101.

The same procedure is followed to flush clean the system during shut-down following printing. Thus, again the ink solvent used resides in holding tank 101.

Blockage may occur of the droplet forming nozzles of generator 5. This blockage may be removed by manually spraying onto the nozzles ink solvent, closing valve 109, opening valve 107, and switching valve 113 to vacuum source 13. Source 13 draws the ink solvent through the nozzles into generator 5 unblocking the nozzles, and then via bleed connection 19 and valve 107 to holding tank 101. Thus, the used ink solvent again resides in holding tank 101. Valves 115, 117, 119, 121 are closed during the operation so that printhead 7 may be switched to vacuum.

Since each of the cleaning processes of the previous three paragraphs results in a liquid comprising predominantly ink solvent residing in holding tank 101, this liquid may be used in printing by the system in place of the ink solvent in reservoir 35. For example, if the flow rate measurement made using level sensors 23, 25 is below that desired, liquid from holding tank 101 may be supplied to return tank 15 instead of ink solvent from reservoir 35. The liquid is supplied by switching valve 113 to atmospheric pressure, and opening valve 111 so that vacuum source 13 draws the liquid from holding tank 101 to return tank 15.

It will be appreciated from the following that the liquid residing in holding tank 101 may not be predominantly ink solvent. Consider a modification to the system of FIG. 2 where the temperature control afforded by temperature sensor 37 and heater/cooler 39/41 is removed, and the velocity of the streams of ink droplets 9 maintained constant by varying the ink composition to cater for ambient temperature change. If the ambient temperature of the print run prior to a present print run was significantly lower (or higher) than that of the present print run, then the composition of the ink in the system at the start of the present print run will be appreciably thinner (thicker) than that appropriate for the present print run. Thus, the system is initially run prior to printing to feed this thinner (thicker) ink into holding tank 101. This thinner (thicker) ink may then later during printing be supplied to return tank 15 when appropriate.

It is to be realized that the purpose of holding tank 101 is to receive liquid that issues from droplet generator 5 during preparation of the system for subsequent printing, so that this liquid may then be used later during the subsequent printing when the conditions of the system are such that it is appropriate to use this liquid. In this connection the aforementioned flush cleaning of the system during shut-down can be considered preparation of the system for subsequent printing, since the cleaning takes place so that the system is not 'dirty' at the beginning of the next print run.

Figure 3:
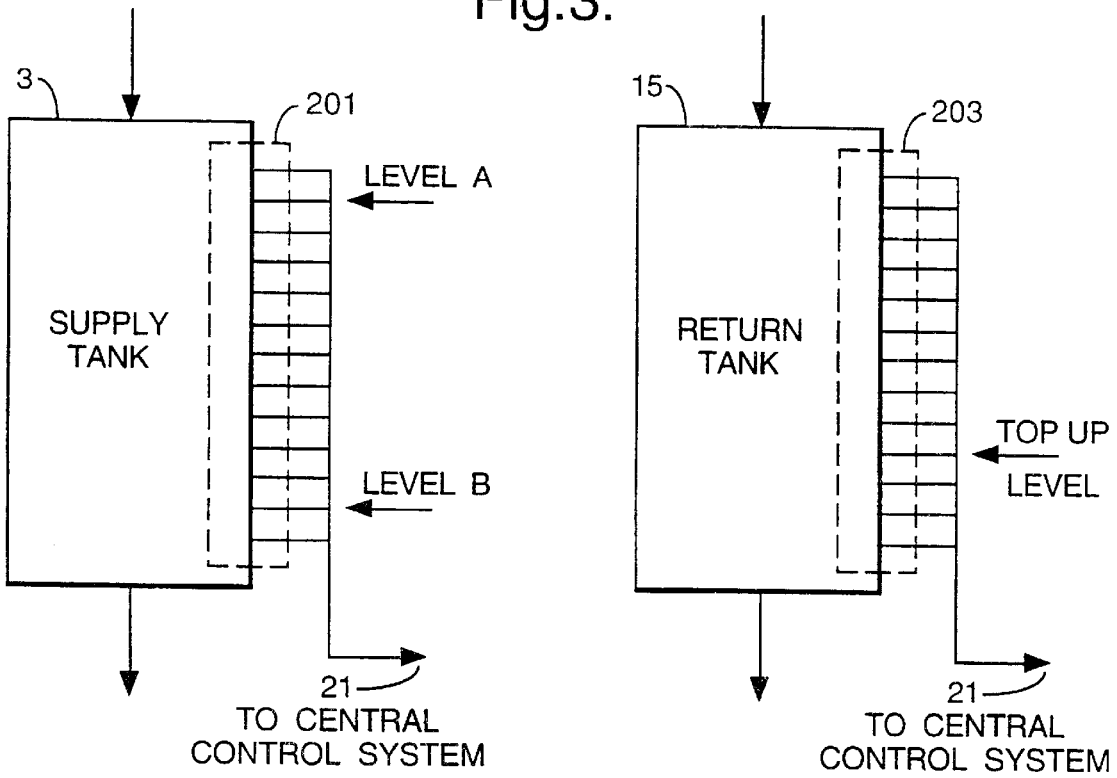
FIG. 3 shows a modification to the system of FIG. 2.

Referring also to FIG. 3, in the modification, level sensors 23 and 25 of supply tank 3 have been replaced by multi-level sensor 201, and level sensor 27 of return tank 15 has been replaced by multi-level sensor 203.

A multi-level sensor comprises at least three level sensors, each of which detects whether liquid height is above or below the level at which it is located. Typically, the number of sensors used is such that they may be located with a frequency of one every 5 to 10 mm of tank height.

Utilising the detection provided by multi-level sensors 201, 203, central control system 21 is able to determine the rate of fall/rise of liquid level in tanks 3, 15 respectively. Control sytem 21 monitors the determined rates, and, if either deviates by more than a predetermined amount from its expected value, provides an indication that there has been a fault in the printing system, and further provides an indication of what this fault is.

The following examples illustrate how control system 21 is able to provide an indication of what the fault is that has occurred. In each example: the occurrence of a particular type of fault is first given (i.e. it is first stated how a particular constituent element of the printing system is not operating as it should be); the effect(s) of the fault occurrence is/are then given; and finally the resultant rise/fall rate in supply tank 3/return tank 15 is given.

If either of valves 117, 119 is stuck closed, the fall in ink level in supply tank 3 that would normally take place, will not. The ink level will remain the same. Thus, the fall rate in supply tank 3 will be zero. Further, gutter 11 will not be supplying unused ink to return tank 15. The rise in ink level in return tank 15 that would normally be taking place, will either not occur at all, if top-up via valves 29, 31, 111 is not taking place, or will occur more slowly. Thus, the rise rate in return tank 15 will either be zero or relatively low.

If either of valves 115, 121 is stuck closed during flushing, the rise in liquid level in holding tank 101 that would normally take place, will not. The level will remain the same. Thus, the rise rate in holding tank 101 will be zero.

If valve 103 is stuck closed, the rise in ink level in return tank 15 that would normally be taking place, will either not occur at all, if top-up via valves 29, 31, 111 is not taking place, or will occur more slowly. Thus, the rise rate in return tank 15 will either be zero or relatively low.

If either valve 105 or valve 107 is stuck closed during flushing, the rise in liquid level in holding tank 101 that would normally be taking place due to the receipt of liquid via both valves 105 and 107, will only be taking place due to the receipt of liquid via one valve 105 or 107, and therefore will take place more slowly. Thus, the rise rate in holding tank 101 will be relatively low.

If valve 45 is stuck closed, the rise in ink level in supply tank 3 that would normally take place when transferring ink from return tank 15 to supply tank 3, will not take place. This ink level will be falling. Thus, the rise rate in supply tank 3 will be negative. Further, the fall in ink level in return tank 15 that would normally be taking place, will not. This level will be rising. Thus, the fall rate in return tank 15 will be negative.

If any one of valves 29, 31, 111 is stuck closed at a time it is instructed to be open, the top-up that would normally be received by return tank 15 via the stuck closed valve 29 or 31 or 111, will not be received, and hence the rise in ink level in return tank 15 will be slower than expected. Thus, the rise rate in return tank 15 will be relatively low.

If valve 105 is stuck open during printing, the rise in ink level in return tank 15 will occur more slowly than expected. Thus, the rise rate in return tank 15 will be relatively low.

If valve 107 is stuck open during printing, when transfer is not taking place from return tank 15 to supply tank 3, the fall in ink level in supply tank 3 will occur more quickly than expected. Thus, the fall rate in supply tank 3 will be relatively high. When transfer is taking place, the rise in ink level in supply tank 3 will occur more slowly than expected. Thus the rise rate in supply tank 3 will be relatively low. In both cases, i.e. not during and during transfer, there will be an unexpected rise in the level in holding tank 101. Thus, the rise rate in holding tank 101 will be positive.

If valve 113 is stuck at vacuum during printing, no top-up from holding tank 101 will be received by return tank 15 when valve 111 is opened. The level in return tank 15 will therefore rise more slowly than expected, and there will be no drop in the level in holding tank 101. Thus, the rise rate in return tank 15 will be relatively low, and the fall rate in holding tank 101 will be zero.

If valve 45 is stuck open when transfer is not required from return tank 15 to supply tank 3, there will be back flow due to the action of vacuum source 13. Hence the level in return tank 15 will be rising more quickly than expected, and the level in supply tank 3 will be falling more quickly than expected. Thus, both the rise rate in return tank 15 and the fall rate in supply tank 3 will be relatively high.

If any one of valves 29, 31, 111 is stuck open at a time it is instructed to be closed, a top-up that would not normally be received by return tank 15 at that time, will be received via stuck open valve 29 or 31 or 111. The level in return tank 15 will therefore rise more quickly than expected. Thus, the rise rate in return tank 15 will be relatively high.

If supply pump 1 fails to operate, the fall in ink level in supply tank 3 that would normally take place, will not. The ink level will remain the same. Thus, the fall rate in supply tank 3 will be zero. Further, gutter 11 will not be supplying unused ink to return tank 15. The rise in ink level in return tank 15 that would normally be taking place, will either not occur at all, if top-up via valves 29, 31, 111 is not taking place, or will occur more slowly. Thus, the rise rate in return tank 15 will either be zero or relatively low.

If transfer pump 17 is worn, both the fall in level in return tank 15 and the rise in level in supply tank 3, will be slower than expected. Thus, both the fall rate in return tank 15 and the rise rate in supply tank 3 will be relatively low. This change in rate may be used to control the speed of transfer pump 17.

If transfer pump 17 fails to operate, the level in return tank 15 will be rising rather than falling as expected, and the level in supply tank 3 will be falling rather than rising as expected. Thus, both the fall rate in return tank 15 and the rise rate in supply tank 3 will be negative.

If cooler 41 is frozen, the fall in ink level in supply tank 3 that would normally take place, will not. The level will remain the same. Thus, the fall rate in supply tank 3 will be zero. During transfer form return tank 15 to supply tank 3, the level in supply tank 3 will rise more quickly than usual. Thus, the rise rate in supply tank 3 will be relatively high. Due to the absence of the supply of unused ink by gutter 11 to return tank 15, when top-up via valves 29, 31, 111 is not taking place, the level in return tank 15 will remain the same, rather than be rising as expected. Thus, the rise rate in return tank 15 will be zero. During transfer from return tank 15 to supply tank 3, the absence of the supply of unused ink will result in the level in return tank 15 falling more quickly than usual. Thus, the fall rate in return tank 15 will be relatively high.

If gutter 11 is not collecting or is collecting little unused ink, during transfer from return tank 15 to supply tank 3 the level in return tank 15 will fall more quickly than expected. Thus, the fall rate in return tank 15 will be relatively high.

When transfer is not taking place, assuming no top-up via valves 29, 31, 111, the level in return tank 15 will either not rise at all or will rise very slowly. Thus, the rise rate in return tank 15 will be zero or relatively very low.

It is to be appreciated that each of multi-level sensors 201, 203 could be replaced by a continuous level sensor which continuously provides to control system 21 measurement of liquid level.

It is also to be appreciated that the indication of what fault it is that has occurred, provided by control system 21, may not be definitively determined by the rise/fall rate in supply tank 3/return tank 15, but may require the supply to control system 21 of other information regarding the condition of the printing system.

What is claimed is:

1. An ink jet printing system comprising: a droplet generator for generating at least one stream of ink droplets; a supply tank for supplying ink to said generator; supply transfer means for driving the ink from said tank to said generator; and measurement means for measuring the flow rate of the stream(s) of ink droplets generated by said generator by monitoring the change of ink level in said tank, said system including a bleed connection from said generator to said tank in closed circuit with said tank, the presence of said bleed connection thereby increasing the rate of flow of ink from said tank to said generator without affecting the measurement by said measurement means of the flow rate of the stream(s) of ink droplets generated by said generator.

2. A system according to claim 1 further comprising: a gutter for collecting ink droplets not used in printing; a return tank for receiving the ink collected in the gutter; and return transfer means for driving ink from said return tank to said supply tank, the flow rate measurements made by monitoring the change of ink level in said supply tank being made when ink is not being driven from the return tank to the supply tank.

3. A system according to claim 2 further comprising control means for maintaining substantially constant the velocity of the stream(s) of ink droplets generated by said droplet generator.

4. A system according to claim 3 wherein said control means controls the composition, temperature, and pressure of the ink in said droplet generator.

5. A system according to claim 4 wherein said control means maintains substantially constant said composition, temperature, and pressure.

6. A system according to claim 5 wherein said control means maintains substantially constant said composition by supplying ink solvent and ink to said return tank, the supply being made in dependence on the ink level in said return tank and the flow rate measurement made by monitoring the change of ink level in said supply tank.

7. A system according to claim 5 wherein said control means maintains substantially constant said temperature by sensing the temperature of the ink in said droplet generator, and, in response thereto, adjusting the temperature of the ink in the ink path from said supply tank to said droplet generator.

8. A system according to claim 5 wherein: said supply transfer means comprises a pump located in the ink path from said supply tank to said droplet generator; and said control means maintains substantially constant said pressure by sensing the pressure of the ink in said generator, and, in response thereto, adjusting the speed of operation of said pump.

9. An ink jet printing system comprising: a droplet generator for generating at least one stream of ink droplets; a supply tank for supplying ink to said generator; supply transfer means for driving the ink from said tank to said generator; a holding tank for receiving liquid issued by said generator during preparation of the system for subsequent printing, said holding tank being connected to said supply tank for the supply of said liquid to the supply tank during said subsequent printing; and means for determining during said subsequent printing the times at which the composition of the ink supplied to said generator is such that it is appropriate to use the liquid contained in said holding tank.

10. A system according to claim 9 further comprising: a gutter for collecting ink droplets not used in printing; a return tank for receiving the ink collected in the gutter; a reservoir of ink solvent connected to the return tank; a reservoir of ink connected to the return tank; and return transfer means for driving ink from said return tank to said supply tank, said holding tank being connected to said return tank and thereby to said supply tank.

11. A system according to claim 10 further comprising: a bleed connection from said generator to said supply tank; and valve means for directing said liquid issued by said generator during preparation from said gutter and said bleed connection to said holding tank.

12. A system according to claim 10 wherein: said preparation of the system for subsequent printing comprises flushing with ink solvent, said liquid received by the holding tank thereby comprising predominantly ink solvent; said system further comprises measurement means for measuring the flow rate of the stream(s) of ink droplets generated by said generator by monitoring the change of ink level in said supply tank when ink is not being driven from said return tank to said supply tank; and said holding tank supplies said liquid to said return tank when the flow rate measured by said measurement means is below that desired.

13. An ink jet printing system comprising: a tank for holding a liquid for use in the operation of said system; a multi-level or continuous level sensor for measuring the rate of change of liquid level in said tank during said operation, said multi-level sensor comprising at least three level sensors each of which detects whether liquid height is above or below the level at which it is located, said continuous level sensor comprising a sensor which continuously provides measurement of said liquid level; and means for using said measurement of the rate of change of said liquid level in said tank to provide an indication that there has been a fault in said system.

14. A system according to claim 13 wherein said means for using also provides an indication of what the fault is that has occurred.

* * * * *